US011034011B2

(12) United States Patent
Bessac et al.

(10) Patent No.: US 11,034,011 B2
(45) Date of Patent: Jun. 15, 2021

(54) CAMPING UTENSIL KIT

(71) Applicant: Fiskars Brands, Inc., Middleton, WI (US)

(72) Inventors: Grant Bessac, Beaverton, OR (US); Charlie Hartzell, Portland, OR (US)

(73) Assignee: Fiskars Brands, Inc., Middleton, WI (US)

( * ) Notice: Subject to any disclaimer, the term of this patent is extended or adjusted under 35 U.S.C. 154(b) by 213 days.

(21) Appl. No.: 16/132,666

(22) Filed: Sep. 17, 2018

(65) Prior Publication Data

US 2019/0084143 A1 Mar. 21, 2019

Related U.S. Application Data

(60) Provisional application No. 62/560,132, filed on Sep. 18, 2017.

(51) Int. Cl.

| | |
|---|---|
| ***B25F 1/02*** | (2006.01) |
| ***A47G 21/06*** | (2006.01) |
| *A45F 5/00* | (2006.01) |
| *A45F 5/10* | (2006.01) |

(52) U.S. Cl.

CPC ..... *B25F 1/02* (2013.01); *A47G 21/06* (2013.01); *A45F 2005/002* (2013.01); *A45F 2005/108* (2013.01)

(58) Field of Classification Search

CPC ..... B25F 1/02; B25F 1/00; B25F 1/04; B25G 1/085; B25G 1/08; A47G 21/06; A45F 2005/002; A45F 2005/108

See application file for complete search history.

(56) References Cited

U.S. PATENT DOCUMENTS

| | | | | |
|---|---|---|---|---|
| 4,539,749 A | | 9/1985 | Hyeong-Woon | |
| 4,789,064 A | * | 12/1988 | Segal | A47G 21/02 206/478 |
| 4,995,154 A | | 2/1991 | Bamber | |
| 5,845,403 A | * | 12/1998 | Nivin | A47G 21/06 30/147 |

(Continued)

FOREIGN PATENT DOCUMENTS

| | | |
|---|---|---|
| DE | 10 01 464 B | 1/1957 |
| WO | WO-2008/030288 A1 | 3/2008 |

OTHER PUBLICATIONS

International Search Report and Written Opinion for International Application No. PCT/US2018/051287, dated Jan. 3, 2019, 14 pages.

*Primary Examiner* — Robert J Scruggs
(74) *Attorney, Agent, or Firm* — Foley & Lardner LLP

(57) ABSTRACT

A camping tool including an eating utensil having a handle and a handle coupling feature, a tool including a bent portion arranged at an oblique angle relative to a body portion, and a tool coupling feature, and a deformable connector engaging the handle coupling feature and the tool coupling feature and biasing the tool toward the eating utensil. The utensil has a primary function when disconnected from the tool, and a secondary function when connected to the tool, and the secondary function includes supporting the camping utensil kit on the bent portion to elevate the food portion above a surface and supporting the camping utensil kit on the edge of a container with the bent portion.

15 Claims, 5 Drawing Sheets

(56) References Cited

U.S. PATENT DOCUMENTS

| | | | | |
|---|---|---|---|---|
| 7,100,288 | B2 * | 9/2006 | Kohler | A45C 11/20 206/499 |
| 8,474,143 | B2 | 7/2013 | Wedderburn | |
| 8,839,522 | B2 | 9/2014 | Walters | |
| 9,468,321 | B2 | 10/2016 | Miksovsky et al. | |
| 2004/0103480 | A1 | 6/2004 | Carlson-Smith | |
| 2011/0035946 | A1 * | 2/2011 | Menceles | A47G 21/02 30/147 |
| 2015/0245744 | A1 * | 9/2015 | Henry | A47J 43/288 7/112 |
| 2016/0066723 | A1 * | 3/2016 | Prommel | A47J 43/283 30/124 |

* cited by examiner

CAMPING UTENSIL KIT

CROSS-REFERENCE TO RELATED APPLICATION

This application claims the benefit of and priority to U.S. Provisional Application No. 62/560,132, filed Sep. 18, 2017, the content of which is hereby incorporated by reference in its entirety and for all purposes.

BACKGROUND

The present invention relates generally to camping tools. More specifically, the present invention relates to camping tools used for eating or cooking.

SUMMARY

One embodiment relates to a camping utensil kit that includes a utensil having a food portion and a handle defining a handle aperture, a tool separate from the utensil and including a tool aperture, and a deformable connector selectively passing through the handle aperture and the tool aperture to maintain the utensil and the tool coupled together.

Another embodiment relates to a camping tool including an eating utensil having a handle and a handle coupling feature, a tool including a bent portion arranged at an oblique angle relative to a body portion, and a tool coupling feature, and a deformable connector engaging the handle coupling feature and the tool coupling feature and biasing the tool toward the eating utensil. The utensil has a primary function when disconnected from the tool, and a secondary function when connected to the tool, and the secondary function includes supporting the camping utensil kit on the bent portion to elevate the food portion above a surface and supporting the camping utensil kit on the edge of a container with the bent portion.

Another embodiment relates to a method that includes engaging a deformable connector through a handle aperture of an eating utensil, engaging the deformable connector through a tool aperture of a tool, biasing the tool toward the eating utensil with the deformable connector, and removing the tool from the eating utensil via movement perpendicular to a handle of the eating utensil.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the drawings, a camping utensil kit is shown and described that includes a utensil that can be used for eating, a bonus tool that includes a bent portion (e.g., a pry bar, nail puller, etc.) and a serrated hook, and a connector that selectively couples the bonus tool to the utensil. The bent portion of the bonus tool provides at least two secondary functions when the bonus tool is coupled to the utensil. First, the bent portion can elevate a food portion of the utensil above a surface that the camping utensil kit is resting on when not being actively used. Second, the bent portion can engage a side of a pot or cup to act as a rest or holder to hang the utensil from the pot or cup when the camping utensil kit is not being actively used.

Figure 1:
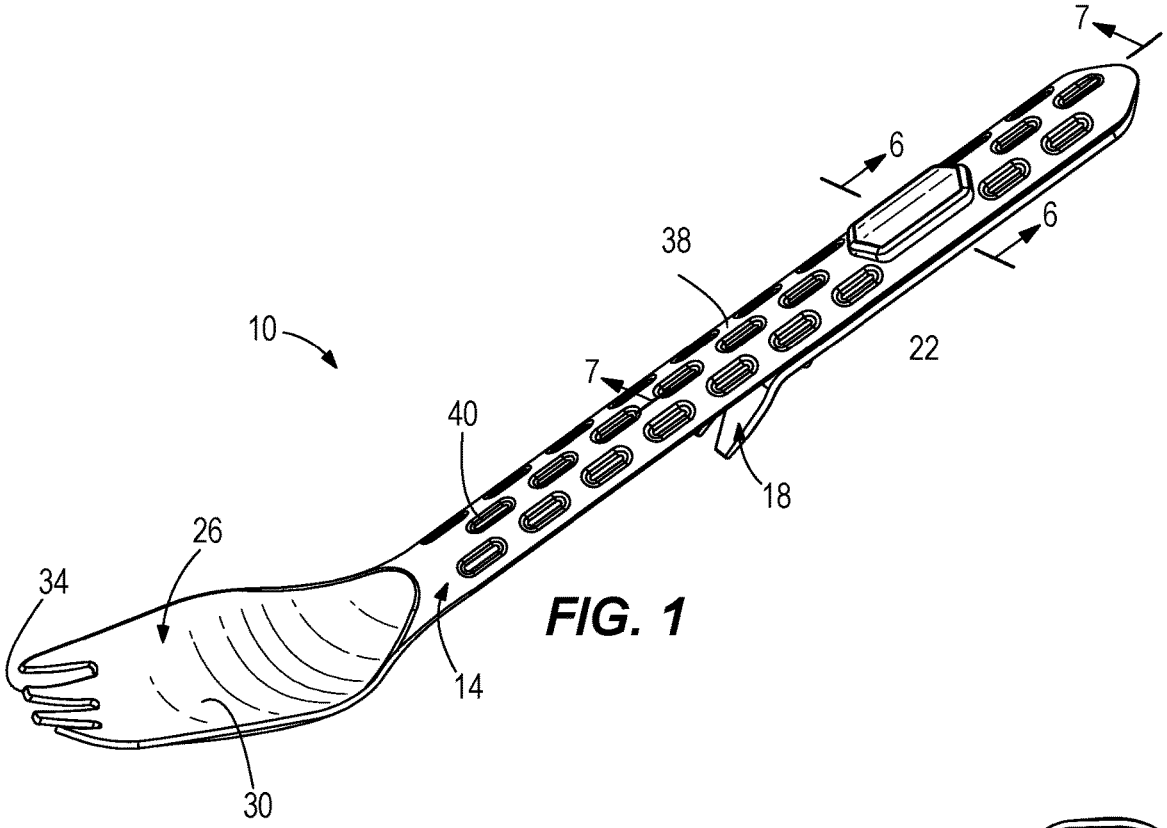
FIG. 1 is a top, left, front perspective view of a camping utensil kit, in accordance with an exemplary embodiment.
Figure 2:
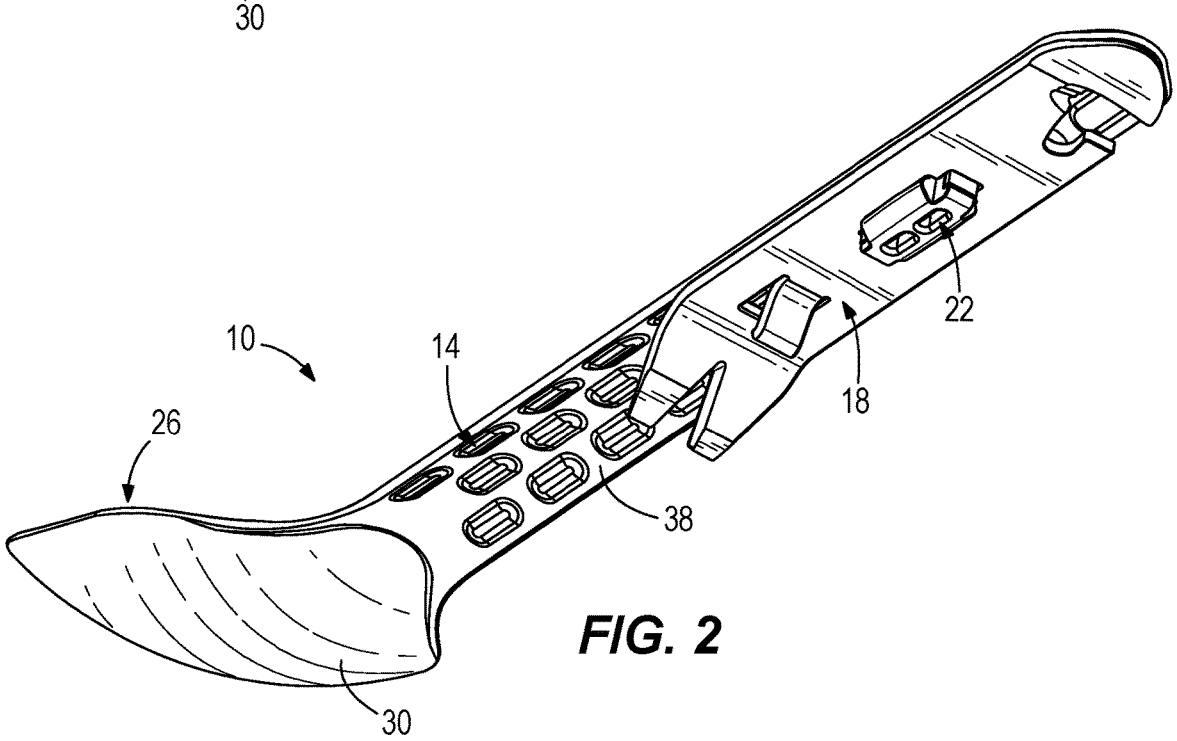
FIG. 2 is a bottom, left, rear perspective view of the camping utensil kit of FIG. 1.

As shown in FIG. 1, a camping utensil kit 10 includes a utensil 14 for eating or manipulating food, a bonus tool 18 that can be used for secondary functions (e.g., cutting opening, etc.), and a connector 22 that selectively couples the utensil 14 and the bonus tool 18 together. As shown in FIG. 2, the connector 22 extends through the utensil 14 and the bonus tool 18 and holds the bonus tool 18 in engagement with the utensil 14.

The utensil 14 includes a food portion 26 in the form of a spoon 30 with fork tines 34, and a handle 38 that includes grip features in the form of dimples 40 and a rounded shape to make the handle 38 more comfortable to grasp. In other embodiments, the food portion 26 can include a sharpened edge, a knife, a spatula, etc. or the spoon 30 and/or fork tines 34 can be eliminated. Other grip features, such as a textured surface or other dimple/projection shapes are contemplated. In other embodiments, the curvature of the handle 38 defines a different radius or has a different shape (e.g., more elliptical), as desired.

Figure 3:
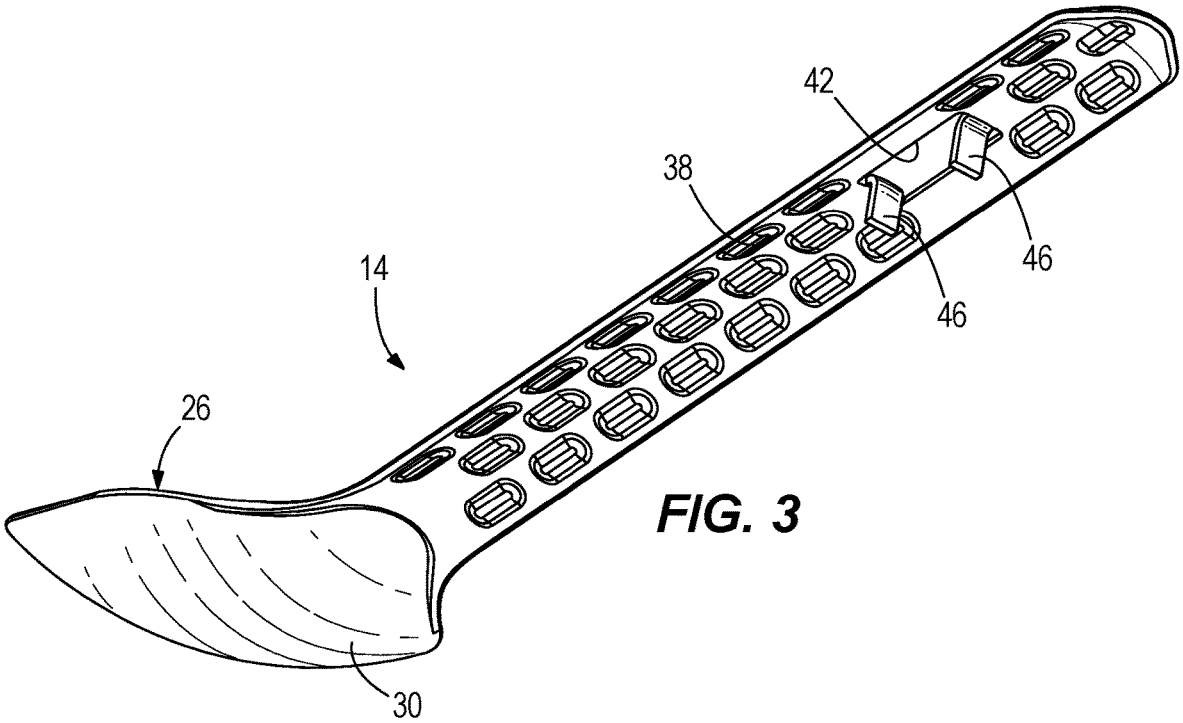
FIG. 3 is a bottom, left, rear perspective view of a utensil of the camping utensil kit of FIG. 1.

As shown in FIG. 3, a handle coupling feature is provided in the form of a handle aperture 42 and two handle tabs 46. The handle aperture 42 is generally rectangular in profile and the two handle flanges or tabs 46 extend substantially perpendicular from the handle 38 adjacent the handle aperture 42. In the illustrated embodiment, the handle tabs 46 are cut from the same piece of material as forms the handle 38 and bent into position. In other embodiments, the handle tabs 46 may be formed differently (e.g., welded in place, adhered, fastened, etc.). In other embodiments, the handle tabs 46 may extend from the handle 38 at an oblique angle.

Figure 4:
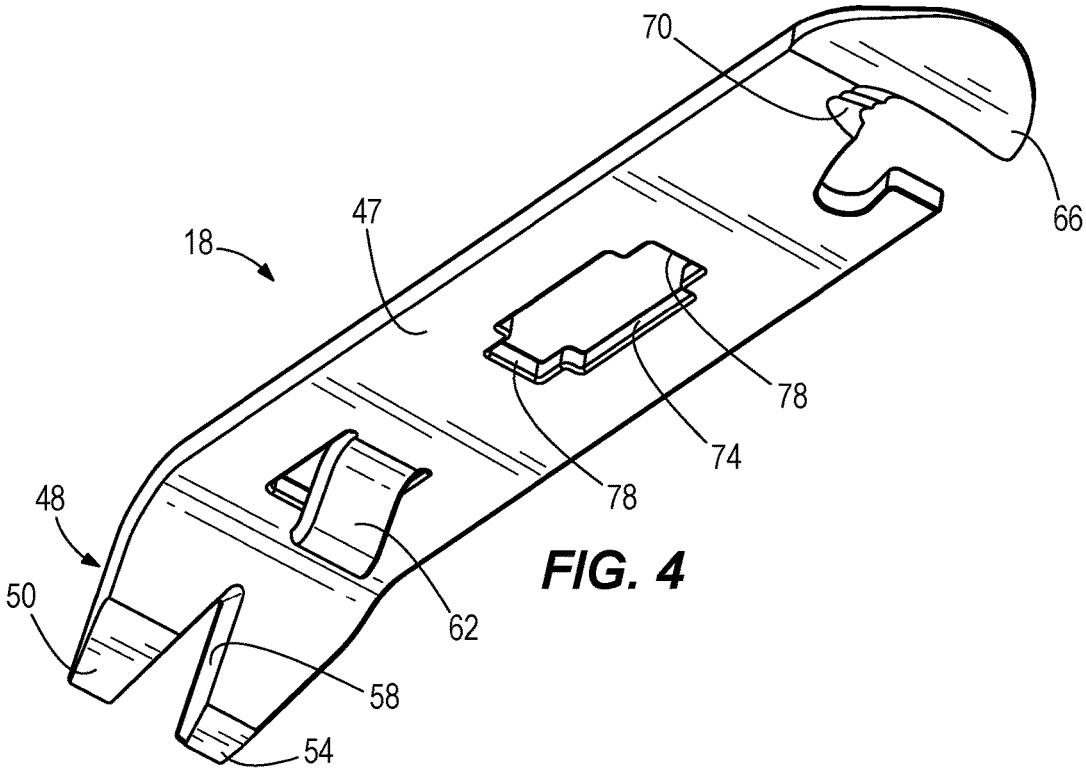
FIG. 4 is a bottom, left, rear perspective view of a bonus tool of the camping utensil kit of FIG. 1.

As shown in FIG. 4, the bonus tool 18 includes a body 47, a bent portion 48 that includes a pry bar 50, a flat head screw driver 54, a nail puller 58, and a bottle opener 62. The bonus tool 18 also includes a can opener 66, and a gut hook or serrated bag opener 70 ground into the bonus tool 18 for opening or cutting through common food packaging. In the illustrated embodiment, the bent portion 48 is arranged at an angle 72 (see FIG. 7) of about one-hundred forty degrees (140°) relative to the body 47. In other embodiments, the angle 72 can be between about thirty degrees (130°) and about fifty degrees (150°) relative to the body 47. The bonus tool 18 may further include other tools as desired. For example, a knife edge, hex opening, box end wrench opening, file, or other tools may be included. Further, some of the tools shown in FIG. 4 may be eliminated. A tool coupling feature in the form of a tool aperture 74 includes two tool recesses 78 sized to receive the handle tabs 46 of the utensil 14. The tool aperture 74 is generally rectangular with the tool recesses 78 extending therefrom.

Figure 5:
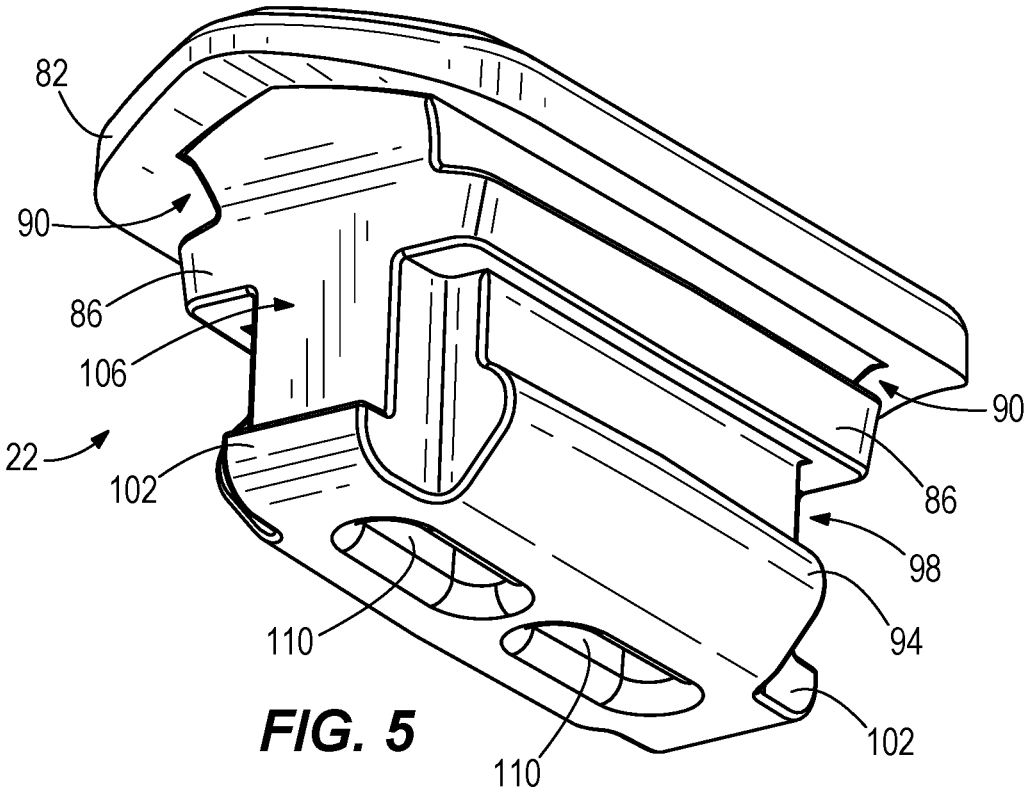
FIG. 5 is a bottom, left, front perspective view of a connector of the camping utensil kit of FIG. 1.

As shown in FIG. 5, the connector 22 includes a top cap 82 spaced apart from a handle shoulder 86 by a handle gap 90, a tool bulb 94 spaced apart from the handle shoulder 86 by a tool gap 98, and a tab shoulder 102 spaced apart from the top cap 82 by a tab gap 106. The connector 22 also includes apertures or recesses 110 positioned to increase the flexibility of the tool bulb 94. In some embodiments, the connector 22 is formed from a rubber or other material with enough flexibility to allow insertion and removal from the handle aperture 42 and the tool aperture 74, while remaining rigid enough to maintain the utensil 14 engaged with the bonus tool 18 during use.

Figure 6:
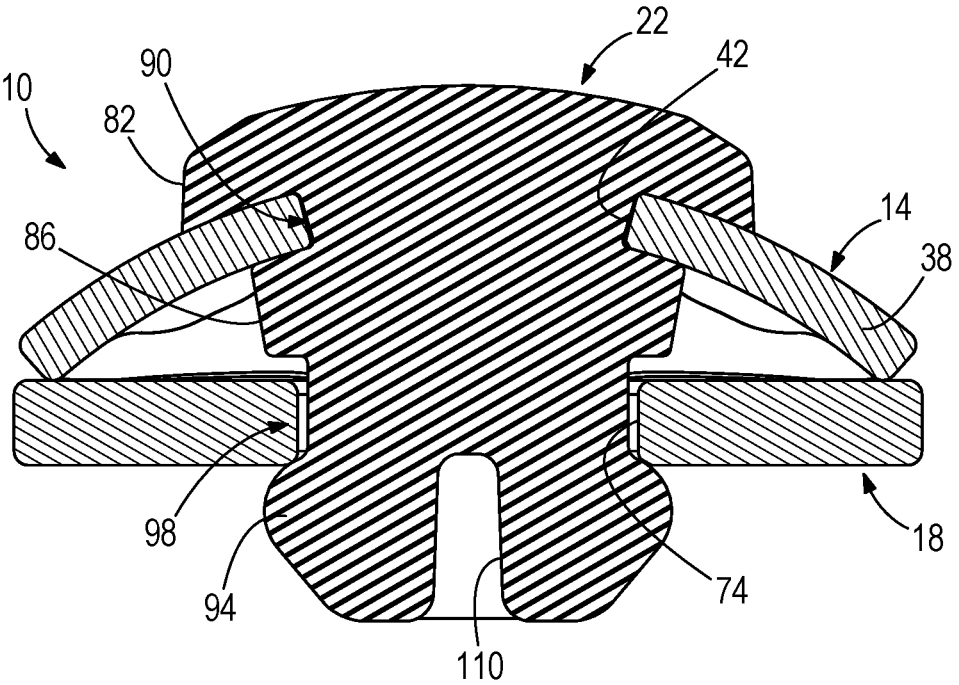
FIG. 6 is a section view of the camping utensil kit of FIG. 1 taken along line 6-6 of FIG. 1.

As shown in FIG. 6, the connector 22 is engaged with the utensil 14 by positioning the handle 38 within the handle gap 90 of the connector 22 between the top cap 82 and the handle shoulder 86. The top cap 82 and handle shoulder 86 are shaped to correspond to the curvature of the handle 14 and to frictionally engage the handle aperture 42. The bonus tool 18 can be coupled to and uncoupled from the assembled utensil 14 and connector 22 by pushing the tool bulb 94 through the tool aperture 74 in a direction perpendicular to the handle 38. The recesses 110 provide additional flexibility allowing the tool bulb 94 to squeeze through the tool aperture, and then expand again to maintain the bonus tool 18 engaged with the utensil 14. The rounded shape of the tool bulb 94 biases the bonus tool 22 toward the utensil 14 and into the tool gap 98 so that the bonus tool 22 remains tightly engaged with the utensil 14. In some embodiments, the bonus tool 22 is maintained in physical contact with the handle 38 of the utensil 14 while engaged. To remove the bonus tool 22, a user pulls the bonus tool 22 away from the utensil 14 causing the tool bulb 94 to contract or squeeze through the tool aperture 74 and release the bonus tool 22.

Figure 7:
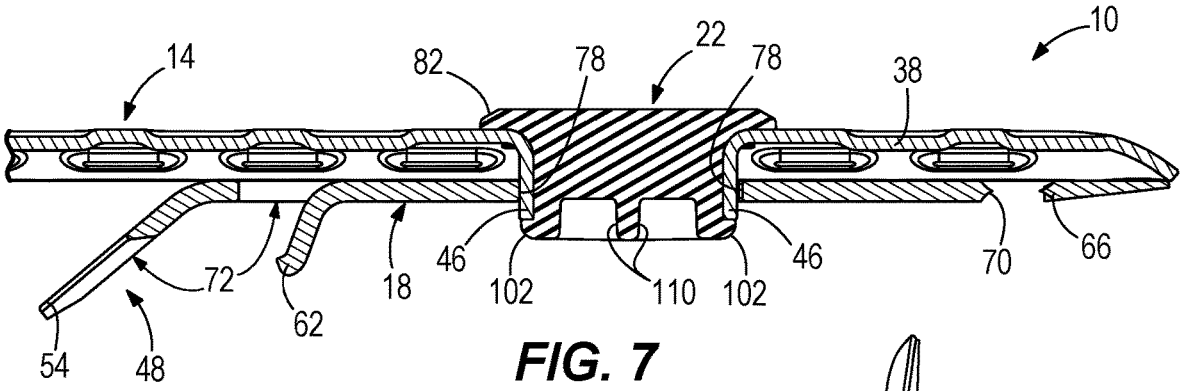
FIG. 7 is a section view of the camping utensil kit of FIG. 1 taken along line 7-7 of FIG. 1.

As shown in FIG. 7, the tab shoulder 102 of the connector 22 is sized to engage and remain engaged with the handle tabs 46 of the handle 38. The tool recesses 78 of the bonus tool 22 are also shown engaged with the handle tabs 46 of the utensil 14 to inhibit rotation of the bonus tool 18 relative to the utensil 14 via rigid contact. The direct contact of the handle tabs 46 and the tool recesses 78 also inhibits lateral (e.g., front-to-back, side-to-side) movement of the bonus tool 18 relative to the utensil 14.

Figure 8:
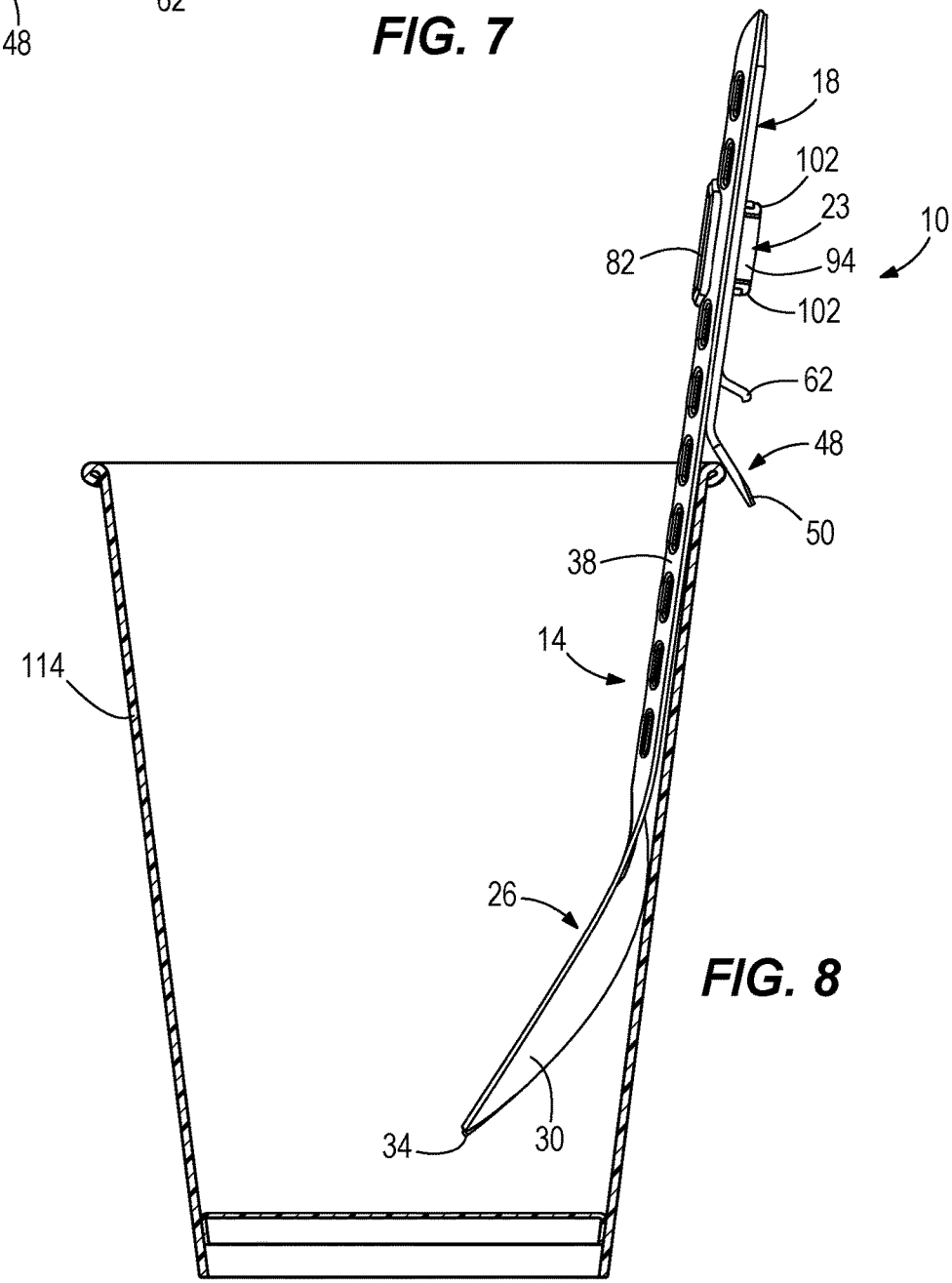
FIG. 8 is a front view of the camping utensil kit of FIG. 1 in a first use configuration.

The utensil 14 and the bonus tool 18 are both structured to be usable independently for specific purposes (e.g., eating, opening food, prying up a nail, etc.). As shown in FIG. 8, the camping utensil kit 10 provides a secondary function when the bonus tool 18 and the utensil 14 are assembled. The oblique angle of the bent portion 48 can engage a top portion or lip of a container in the form of a pot or cup 114 and inhibit the camping utensil kit 10 from falling into the pot or cup 114 or getting food onto the handle 38.

Figure 9:
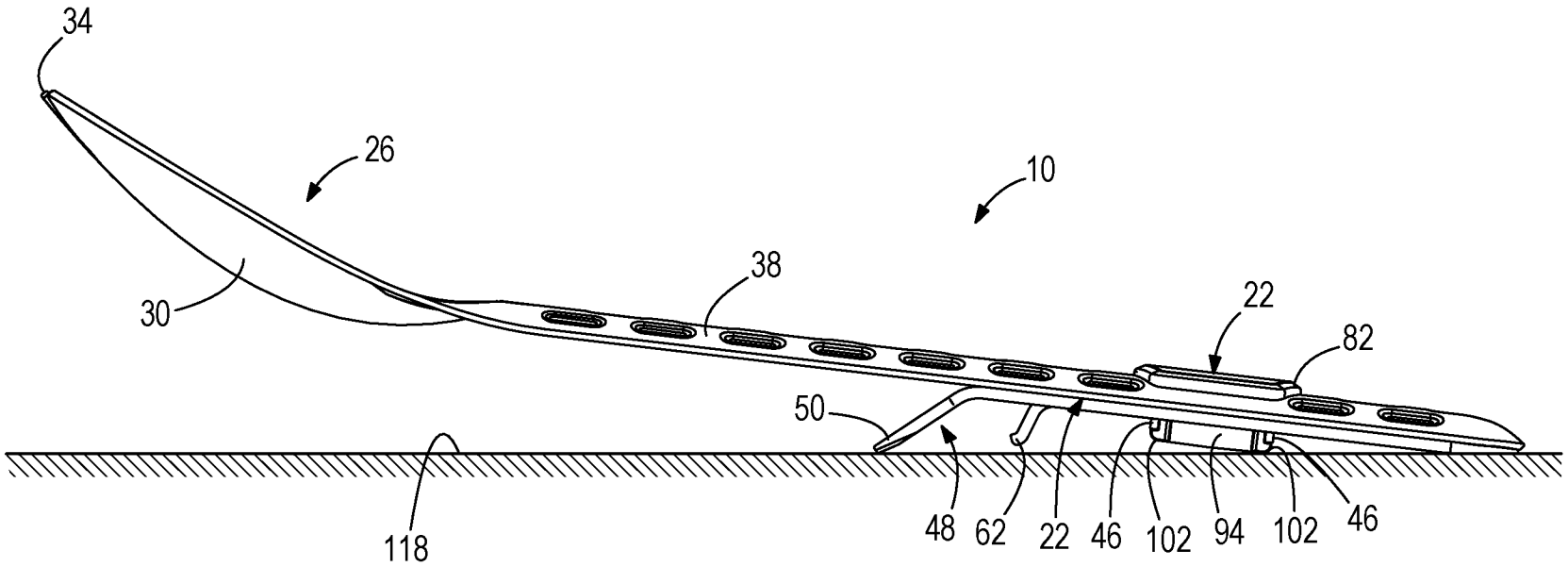
FIG. 9 is a front view of the camping utensil kit of FIG. 1 in a second use configuration.

As shown in FIG. 9, the camping utensil kit 10 provides another secondary function when the bonus tool 18 and the utensil 14 are assembled. The oblique angle of the bent portion 48 can rest against a surface 118 and inhibit food portion 26 of the utensil 14 from contacting the surface 118. Other secondary functions of the assembled camping utensil kit 10 are conceivable and provided by the cooperation of the bonus tool 18 and the utensil 14.

While the detailed drawings and specific examples given describe various exemplary embodiments of the camping utensil kit, they serve the purpose of illustration only. It is to be understood that the invention is not limited in its application to the details of construction and the arrangements of components set forth in the preceding description or illustrated in the drawings. Furthermore, other substitutions, modifications, changes, and omissions may be made in the design, operating conditions, and arrangements of the exemplary embodiments without departing from the scope of the invention.

What is claimed is:

1. A camping utensil kit, comprising:

an eating utensil including a food portion and a handle defining a handle aperture;

a tool separate from the utensil and including a tool aperture; and a deformable connector selectively passing through the handle aperture and the tool aperture to maintain the utensil and the tool coupled together, wherein the eating utensil includes a tab structured to inhibit rotation of the tool relative to the eating utensil when the tab is engaged with the tool aperture.

2. The camping utensil kit of claim 1, wherein the utensil has a primary function when disconnected from the tool, and a secondary function when connected to the tool.

3. The camping utensil kit of claim 2, wherein the tool includes a bent portion, and wherein the secondary function includes supporting the camping utensil kit on the bent portion to elevate the food portion above a surface.

4. The camping utensil kit of claim 2, wherein the tool includes a bent portion, and wherein the secondary function includes supporting the camping utensil kit on an edge of a container with the bent portion.

5. The camping utensil kit of claim 1, wherein the tool includes a bent portion arranged at an oblique angle relative to a body of the tool.

6. The camping utensil kit of claim 5, wherein the oblique angle is about one-hundred forty degrees.

7. The camping utensil kit of claim 1, wherein the tab extends substantially perpendicular to the handle.

8. The camping utensil kit of claim 1, wherein the tab extends through the tool aperture and inhibits rotation of the tool relative to the utensil when engaged with the tool aperture.

9. The camping utensil kit of claim 1, wherein the tab is positioned to engage a portion of the tool aperture to limit movement between the utensil and the tool, and wherein the connector includes a tab shoulder structured to engage the tab.

10. The camping utensil kit of claim 1, wherein the tool includes a serrated hook.

11. The camping utensil kit of claim 1, wherein the connector includes a tool bulb structured to deform as it passes through the tool aperture.

12. The camping utensil kit of claim 11, wherein the tool bulb biases the tool toward the utensil when the tool is engaged with the utensil.

13. The camping utensil kit of claim 1, wherein the tool and the utensil are coupled and decoupled via movement substantially perpendicular to the handle.

14. A method comprising:

engaging a deformable connector through a handle aperture of an eating utensil;

engaging the deformable connector through a tool aperture of a tool;

biasing the tool toward the eating utensil with the deformable connector; and removing the tool from the eating utensil via movement perpendicular to a handle of the eating utensil, wherein the step of engaging the deformable connector through the handle aperture of the eating utensil includes engaging the deformable connector with at least one tab extending away from the handle, wherein the at least one tab is configured to inhibit rotation of the tool relative to the eating utensil when the tab is engaged with the tool aperture.

15. The method of claim 14, further comprising engaging the at least one tab extending from the handle and a tool recess defined in the tool; and inhibiting movement between the eating utensil and the tool.

* * * * *